US011849793B2

(12) United States Patent
Kele et al.

(10) Patent No.: US 11,849,793 B2
(45) Date of Patent: Dec. 26, 2023

(54) FLEXIBLE SLIP PLANE FOR HELMET ENERGY MANAGEMENT LINER

(71) Applicant: Bell Sports, Inc., Scotts Valley, CA (US)

(72) Inventors: Paul A. Kele, Soquel, CA (US); David T. Debus, Felton, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 1276 days.

(21) Appl. No.: 16/370,790

(22) Filed: Mar. 29, 2019

(65) Prior Publication Data

US 2020/0305536 A1 Oct. 1, 2020

(51) Int. Cl.
*A42B 3/12* (2006.01)
*A42B 3/14* (2006.01)

(52) U.S. Cl.
CPC ..... *A42B 3/147* (2013.01); *A42B 3/124* (2013.01)

(58) Field of Classification Search
CPC ..... A42B 3/147; A42B 3/124; A42B 3/066; A42B 3/064
See application file for complete search history.

(56) References Cited

U.S. PATENT DOCUMENTS 5,012,533 A 5/1991 Raffler
2002/0073479 A1 6/2002 Epperson et al.
2007/0192943 A1 8/2007 McDuff
2009/0031482 A1* 2/2009 Stokes ..... A42B 3/145 2/424
2010/0101005 A1 4/2010 Cripton et al.
2010/0299812 A1 12/2010 Maddux et al.
2012/0011639 A1 1/2012 Beauchamp et al.
2012/0180199 A1* 7/2012 Chilson ..... A42B 3/32 2/171.2
2013/0000017 A1 1/2013 Szalkowski et al.
2014/0007328 A1* 1/2014 Brine, III ..... A42B 3/125 2/424
2014/0020158 A1 1/2014 Parsons et al.
2014/0173810 A1 6/2014 Suddaby
2015/0157083 A1* 6/2015 Lowe ..... A42B 3/128 2/412
2015/0223547 A1* 8/2015 Wibby ..... A42B 3/064 2/414
2016/0000168 A1 1/2016 Allen
2016/0235133 A1 8/2016 Chase, Jr. et al.
2017/0105470 A1 4/2017 Eaton
(Continued)

*Primary Examiner* — Richale L Quinn
(74) *Attorney, Agent, or Firm* — Reed Smith LLP; Amardeep S. Grewal; Anupma Sahay

(57) ABSTRACT

A helmet with an inner liner and an outer liner that slidably move in relation to each other. At least one flexible connector is positioned at the ovoid surface between the inner and outer liner that directly connects at least three of a plurality of liner ribs of the first liner segment to the second liner segment across a gap at a center portion of a second liner segment and at left and right sides of the second liner segment. The at least one flexible connector is in-molded with the first and second liner segments so that they move relative to each other when the inner liner slidably moves in relation to the outer liner by flexing the at least one flexible connector. Elastomeric anchors coupled to the outer liner and to the at least one flexible connector may be included, and a fit system may be used.

20 Claims, 6 Drawing Sheets

(56) References Cited

U.S. PATENT DOCUMENTS

| | | | | |
|---|---|---|---|---|
| 2017/0119080 | A1 | 5/2017 | Allen | |
| 2017/0347736 | A1* | 12/2017 | Penner | A42B 3/145 |
| 2017/0367428 | A1* | 12/2017 | Bayer | A42B 3/0473 |
| 2018/0055133 | A1* | 3/2018 | Erb | A42B 3/125 |
| 2018/0125143 | A1 | 5/2018 | Herbert et al. | |
| 2020/0305534 | A1 | 10/2020 | Chilson | |

* cited by examiner

FLEXIBLE SLIP PLANE FOR HELMET ENERGY MANAGEMENT LINER

TECHNICAL FIELD

Aspects of this document relate generally to multiple-liner helmets, and more specifically to a helmet comprising multiple liners having a flexible slip plane between them.

BACKGROUND

Protective headgear and helmets have been used in a wide variety of applications and across a number of industries including sports, athletics, construction, mining, military defense, and others, to prevent damage to a user's head and brain. Contact injury to a user can be prevented or reduced by helmets that prevent hard objects or sharp objects from directly contacting the user's head. Non-contact injuries, such as brain injuries caused by linear or rotational accelerations of a user's head, can also be prevented or reduced by helmets that absorb, distribute, or otherwise manage energy of an impact. This may be accomplished using multiple layers of energy management material.

Conventional helmets having multiple energy management liners are able to reduce the rotational energy transferred to the head and brain by facilitating the rotation of the energy management liners against one another. Shaping the interface between energy management liners to have spherical symmetry would facilitate such a rotation. However, the consequences of such symmetry may include larger size, an undesirable length to width ratio, and/or decreased effectiveness due to insufficient energy management material.

SUMMARY

According to an aspect of the disclosure, a helmet may comprise a helmet body comprising an outer liner and an inner liner each formed of energy-management material and configured to slidably move in relation to each other, the inner liner separate from the outer liner and having a latitudinal radius of curvature for an outer surface of the inner liner that is smaller than a longitudinal radius of curvature for the outer surface of the inner liner such that the outer surface of the inner liner defines an ovoid surface, the inner liner comprising first and second separate liner segments formed of separate expanded polystyrene (EPS) portions and having a gap between the first and second liner segments such that the first and second liner segments do not touch each other, the first liner segment comprising a plurality of liner ribs extending from a front of the first liner segment, each of the plurality of liner ribs separated from another of the plurality of liner ribs by an adjacent gap, at least one flexible connector positioned at the ovoid surface and directly connecting at least three of the plurality of liner ribs of the first liner segment to the second liner segment across the gap at a center portion of the second liner segment and at left and right sides of the second liner segment, the at least one flexible connector in-molded with the first and second liner segments wherein the first and second liner segments are configured to move relative to each other when the inner liner slidably moves in relation to the outer liner by flexing the at least one flexible connector, at least two elastomeric anchors coupled to the outer liner and to the at least one flexible connector, and a fit system coupled to the helmet body, the fit system comprising at least an occipital support that is also coupled to that at least one flexible connector.

Particular embodiments of the disclosure may comprise one or more of the following features. At least one of the at least two elastomeric anchors may be disposed proximate the front of the first liner segment. The at least one flexible connector may be formed of nylon. The at least one flexible connector may extend between the plurality of liner ribs. The inner liner may further comprise a fit system hanger coupling to the at least one flexible connector.

According to an aspect of the disclosure, a helmet may comprise a helmet body comprising an outer liner and an inner liner each formed of energy-management material and configured to slidably move in relation to each other, the inner liner separate from the outer liner and having a latitudinal radius of curvature for an outer surface of the inner liner that is different than a longitudinal radius of curvature for the outer surface of the inner liner, the inner liner comprising first and second separate liner segments and having a gap between the first and second liner segments, the first liner segment comprising a plurality of liner ribs extending from a front of the first liner segment, each of the plurality of liner ribs separated from another of the plurality of liner ribs by an adjacent gap, at least one flexible connector positioned at the outer surface of the inner liner and directly connecting at least three of the plurality of liner ribs of the first liner segment to the second liner segment across the gap at a center portion of the second liner segment and at left and right sides of the second liner segment, the at least one flexible connector in-molded with the first and second liner segments wherein the first and second liner segments are configured to move relative to each other when the inner liner slidably moves in relation to the outer liner by flexing the at least one flexible connector, at least two elastomeric anchors coupled to the outer liner and to the at least one flexible connector, and a fit system coupled to the helmet body.

Particular embodiments of the disclosure may comprise one or more of the following features. At least one of the at least two elastomeric anchors may be disposed proximate the front of the first liner segment. The at least one flexible connector may be formed of nylon. The at least one flexible connector may extends between the plurality of liner ribs. The inner liner may further comprise a fit system hanger coupling to the at least one flexible connector.

According to an aspect of the disclosure, a helmet may comprise a helmet body comprising an outer liner and an inner liner each formed of energy-management material and configured to slidably move in relation to each other, the inner liner separate from the outer liner and comprising first and second separate liner segments and having a gap between the first and second liner segments, at least one flexible connector positioned at an outer surface of the inner liner and directly connecting the first liner segment to the second liner segment across the gap at a center portion of the second liner segment and at left and right sides of the second liner segment, the at least one flexible connector in-molded with the first and second liner segments wherein the first and second liner segments are configured to move relative to each other when the inner liner slidably moves in relation to the outer liner by flexing the at least one flexible connector, at least two elastomeric anchors coupled to the outer liner and to the at least one flexible connector, and a fit system coupled to the helmet body.

Particular embodiments of the disclosure may comprise one or more of the following features. At least one of the at least two elastomeric anchors may be disposed proximate a front of the first liner segment. The at least one flexible connector may be formed of nylon. The first liner segment may comprise a plurality of liner ribs extending from a front of the first liner segment, the at least one flexible connector extending between the plurality of liner ribs. The inner liner may further comprise a fit system hanger coupling to the at least one flexible connector.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1:
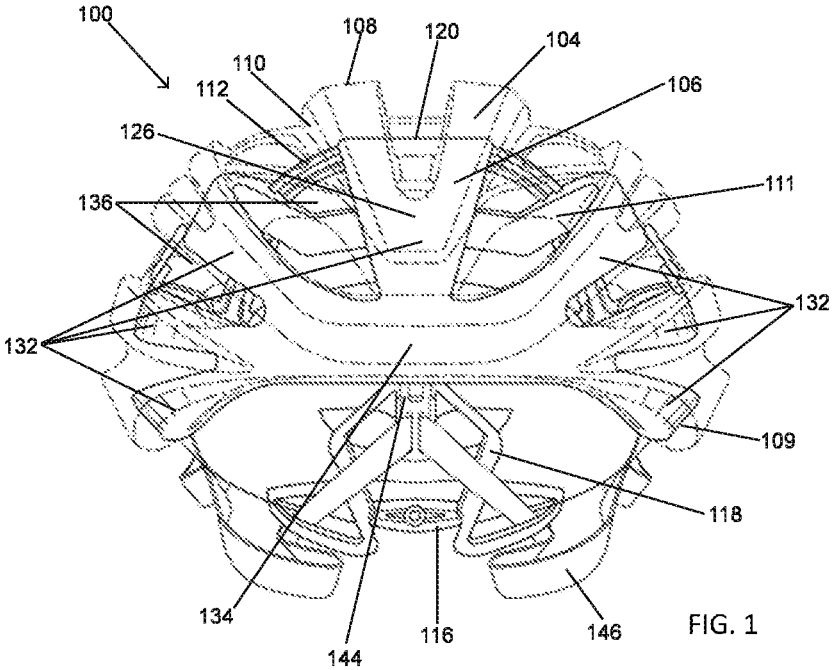
FIG. 1 is a front view of a multi-liner helmet with a flexible curvilinear interface, with the outer liner shown as translucent.

This disclosure, its aspects and implementations, are not limited to the specific helmet or material types, or other system component examples, or methods disclosed herein. Many additional components, manufacturing and assembly procedures known in the art consistent with the helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

While this disclosure includes embodiments in many different forms, there are shown in the drawings, and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Conventional helmets having multiple energy management liners reduce the rotational energy of an impact transferred to the head and brain by facilitating the rotation of the energy management liners against one another. Shaping the interface between energy management liners to have spherical symmetry, essentially forming a ball joint interface, would facilitate such rotation.

However, there are consequences of that spherical symmetry. By requiring the energy management liners to interface with each other along a spherical surface, sacrifices are often made. To compensate for the spherical interface, either the helmet is made larger and/or more spherical overall to accommodate the spherical interface between liners, or segments of the liners may be made too thin to be effective. For example, a helmet with a conventional form factor and a spherical interface between liners might have an inner liner that is too thin at the front and back of the user's head for adequate protection, and an outer liner too thin along the sides. Additionally, these constraints may result in a helmet design that is difficult, if not impossible, to manufacture.

Contemplated as part of this disclosure is a multi-liner helmet 100 having an interface between the liners. The helmet 100 is configured to allow translational movement between the liners at the interface so that the helmet may effectively attenuate rotational energy on impact by rotating in any needed direction, regardless of the shape of the interface. FIGS. 1-6 depict a non-limiting embodiment of a helmet 100. FIG. 1 illustrates a helmet 100 that includes a helmet body that includes an outer liner 104 and an inner liner 106. The translational movement between the liners may absorb energy in a variety of ways. For example, different components of the helmet 100, especially of the inner liner 106, may deform to absorb a portion of the impact energy.

The interior surface of the outer liner 104 and the exterior surface of the inner liner 106 interact with each other across a curvilinear interface which, in particular embodiments, may have a flexible shape. This is advantageous to conventional helmets because, upon impact, the flexibility of the curvilinear interface allows the inner liner 106 to conform to the interior surface of the outer liner 104 as the outer liner 104 moves with respect to the inner liner 106. This elastic deformation of the inner liner 106 absorbs the rotational energy across a significant portion of the liner over a longer time than a conventional helmet, resulting in better attenuation of the rotational acceleration/deceleration of the user's head and brain.

In some embodiments, each of the liners 104, 106 may include a shell 108, 109 and/or an energy management layer 110, 111. The shell 108, 109 may be formed of a plastic material, such as polycarbonate (PC). However, in other embodiments, the shell 108, 109 may also or alternatively be formed of polyethylene terephthalate (PET), KEVLAR, ABS plastic, carbon fiber, fiberglass, and the like. In some embodiments, the energy management layer 110, 111 may be formed of expanded polystyrene (EPS). However, in other embodiments, the energy management layer 110, 111 may also or alternatively be formed of expanded polyurethane (EPU), expanded polyolefin (EPO), expanded polypropylene (EPP), or other energy management or energy absorbing materials. The energy management layer 110, 111 may be bonded directly to the inside of the shell 108, 109. In some embodiments, the outer liner 104 may have more than one shell 108. For example, in one embodiment, the outer liner 104 may have an upper PC shell 108 and a lower PC shell 108.

Figure 2:
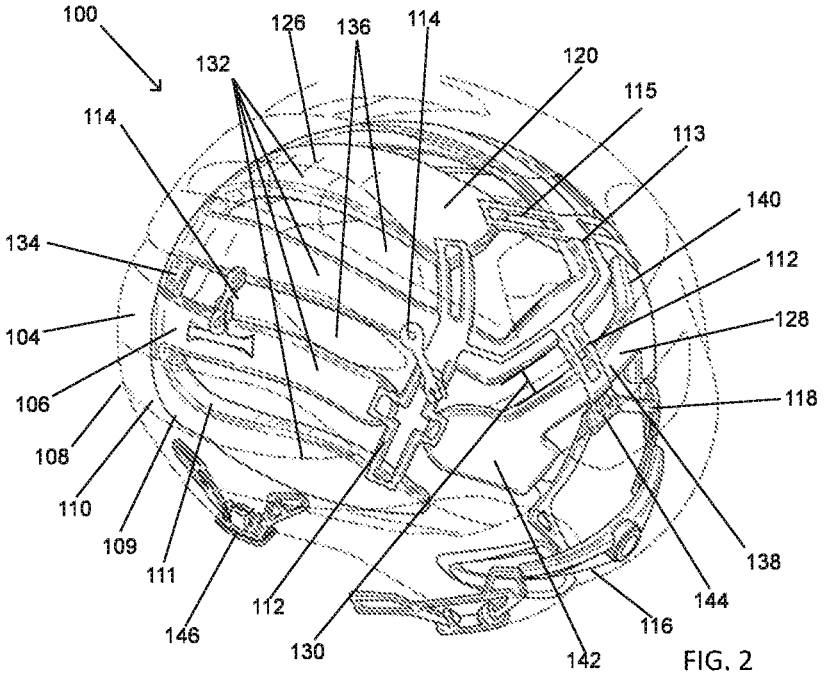
FIG. 2 is a perspective rear view of the helmet shown in FIG. 1, with the outer liner shown as translucent.

FIG. 2 illustrates a view of helmet 100 which shows various components which may be included in different embodiments. For example, the helmet may include an outer liner 104, an inner liner 106, flexible connectors 112, elastomeric anchors 114, and/or a fit system 116. As shown, helmet 100 has an outer liner 104 and an inner liner 106 which are coupled together by at least one elastomeric anchor 114. The elastomeric anchors 114 may be used to couple the inner liner 106 to the outer liner 104, and may be placed at various points on the shell 108 of the inner liner 106 to hold the inner liner 106 in a position proximal to the outer liner 104. This allows the outer liner 104 to rotate along the curvilinear interface with respect to the inner liner 106 while remaining attached. The elastomeric anchors 114 may be attached to the liner 104, 106 through the use of a pin, screw, insert, or other fastener. For example, the anchor 114 may include a loop on each end through which a pin, screw, insert, or other fastener could be inserted. Once the fastener has been attached to the liner 104, 106, the loop holds the anchor to the liner 104, 106. The elastic properties of the elastomeric anchors 114 may absorb some of the energy of an impact, lessening the amount of energy that is transferred to the user, and therefore limiting the harm done during impact.

Figure 3:
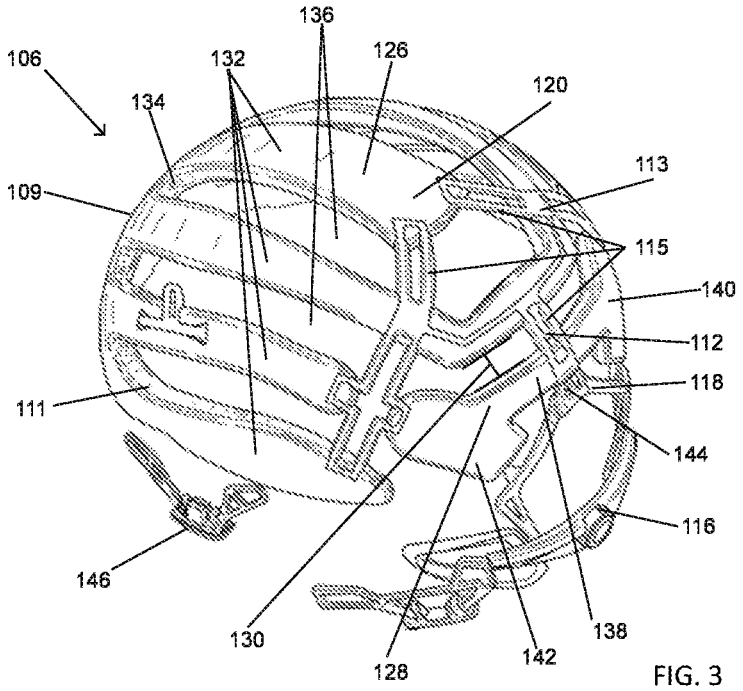
FIG. 3 is a perspective rear view of the an inner liner of the helmet shown in FIG. 1.

As illustrated in FIG. 3, some embodiments of the helmet 100 also include at least one flexible connector 112. A flexible connector 112 may include hinge sections 113 which are made thinner, and therefore more flexible, than the main sections 115 of the flexible connector 112. Therefore, when the flexible connector 112 deflects, the majority of the deformation will occur at or near the hinge section 113. The flexible connectors 112 may be partially embedded in the inner liner 106. In such embodiments, the flexible connectors 112 may be placed inside of the mold and incorporated into the liner during the molding process. Flexible connectors 112 may also or alternatively be incorporated into the inner liner 106 after the inner liner 106 has been molded. Other embodiments may connect the flexible connector 112 to the inner liner 106 through the use of a pin, screw, or other type of fastener.

Figure 6:
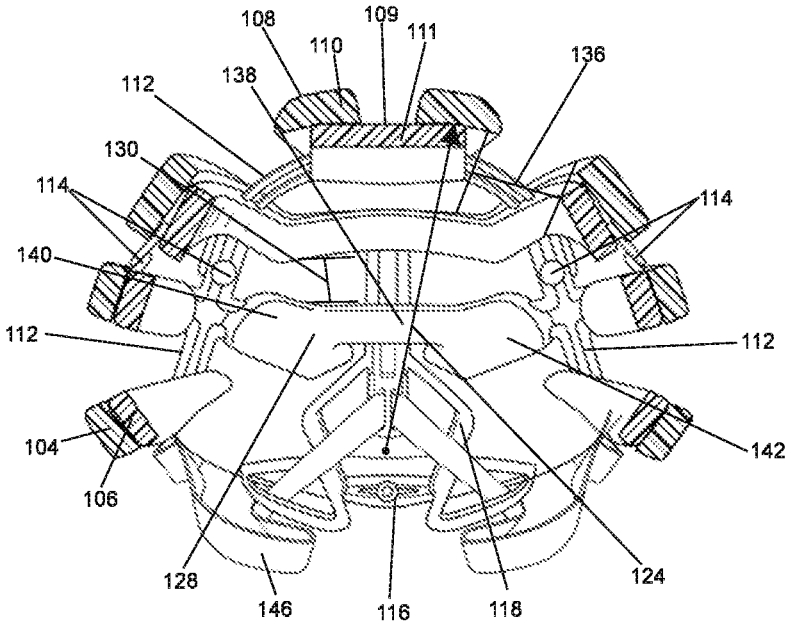
FIG. 6 is a cross-sectional view of the liner shown in FIG. 4 taken along cross-section line 6-6.

The inner liner 106 comprises an outer surface 120 which has a longitudinal radius of curvature 122 (see FIG. 5) and a latitudinal radius of curvature 124 (see FIG. 6). In some embodiments, the longitudinal radius of curvature 122 is smaller or larger than the latitudinal radius of curvature 124, and the outer surface 120 is not a sphere, but is an ovoid. The inner liner 106 may be divided into a first liner segment 126 and a second liner segment 128, with a gap 130 between the two segments. The gap 130 may be large enough that the first liner segment 126 and the second liner segment 128 do not touch each other. In some embodiments, the flexible connector 112 has sections which are embedded within both the first liner segment 126 and the second liner segment 128, thus connecting the two segments. This allows the inner liner 106 to rotate in any direction along the curvilinear interface, despite having an ovoid shape, because the portions of the flexible connector 112 which span the gap 130 between the first liner segment 126 and the second liner segment 128 can flex to accommodate the contours of the outer liner 104. This flexion of the connectors 112 helps the curvilinear interface to be flexible, and to absorb rotational energy through the inner liner 106. The inner liner 106 deforms to conform to the interior surface of the outer liner 104 as the outer liner 104 rotates with respect to the inner liner 106. The elastic deformation of the flexible connector 112 in the inner liner 106 absorbs the rotational energy across a significant portion of the liner over a longer time than a conventional helmet, resulting in better attenuation of the rotational acceleration/deceleration of the user's head and brain.

In some embodiments, the first liner segment 126 has a plurality of liner ribs 132 which extend back from a front 134 of the first liner segment 126. Each liner rib 132 is separated from each adjacent liner rib 132 along a majority of its length by an adjacent gap 136. Because each of the liner ribs 132 is separated from the others along a majority of its length (the exception being where the liner ribs 132 join together at the front 134 of the first liner segment 126 and where some liner ribs 132 may be joined to other liner ribs 132 by a flexible connector 112), the liner ribs 132 are free to deflect by small amounts to conform to the inner surface of the outer liner 104 when the outer liner 104 rotates. A single flexible connector 112 may be embedded in the center portion 138 of the second liner segment 128, span the gap 130, and be embedded in multiple liner ribs 132 across the gap 130. Similarly, another flexible connector 112 may be embedded in the right side 140 or left side 142 of the second liner segment 128, span the gap 130, and have different portions of the second flexible connector 112 each be embedded in different, multiple liner ribs 132 across the gap 130. This connects the first liner segment 126 to the second liner segment 128 in a number of locations through the use of the flexible connectors 112, making the inner liner flexible to adapt to the alterations to the interface plane shape as the inner liner 106 and the outer liner 104 rotate in relation to each other. This further provides both stability and flexibility to the inner liner 106, allowing the inner liner 106 to conform to the shape of the inner surface of the outer liner 104 while still providing efficient protection to the user's head and brain.

Figure 4:
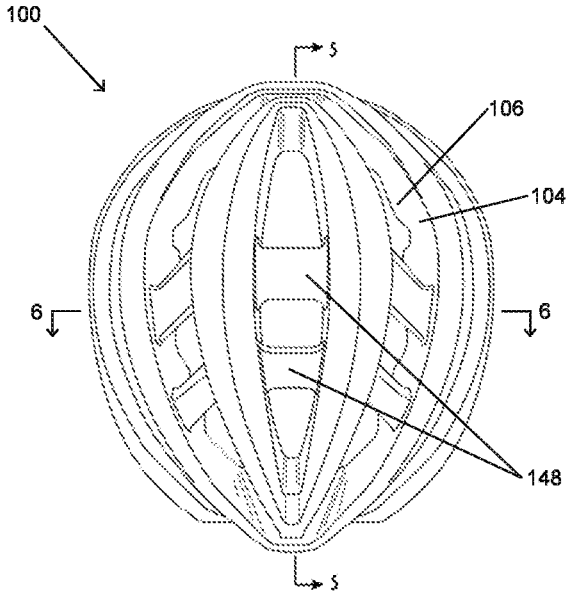
FIG. 4 is a top view of the helmet shown in FIG. 1.
Figure 5:
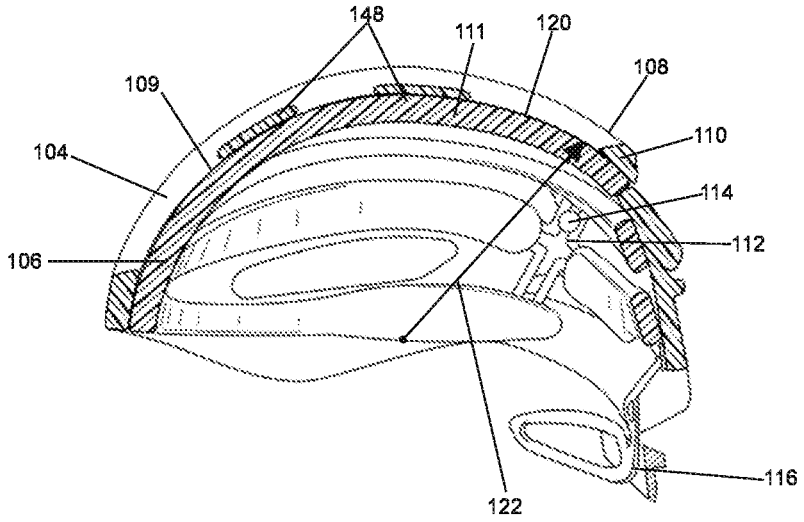
FIG. 5 is a cross-sectional view of the liner shown in FIG. 4 taken along cross-section line 5-5.

The helmets of this disclosure may comprise any other features of protective helmets previously known in the art, such as but not limited to straps, comfort liners, masks, visors, and the like. For example, in some embodiments, the inner liner 106 may include a fit system 116 to provide improved comfort and fit, as illustrated in FIG. 3. The fit system 116 may include a fit system hanger 144 which couples with a flexible connector 112 and suspends the fit system 116 inside of the inner liner 106. The fit system 116 allows the user to adjust the fit of the helmet 100 to different head shapes and sizes. In some embodiments, the fit system 116 comprises an occipital support 118 which, when the helmet 100 is in use, sits on the back of the user's head. The occipital support 118 may be coupled with at least one of the flexible connectors 112. The fit system 116 may also include a chin strap 146 which hangs down from the fit system and can be looped around a user's chin to help hold the helmet 100 in place during use. In addition, in some embodiments, the outer liner 104 may include at least one cross beam 148, as illustrated in FIG. 4, to give additional support to the structure of the outer liner 104.

This disclosure, its aspects and implementations, are not limited to the specific components or assembly procedures disclosed herein. Many additional components and assembly procedures known in the art consistent with the intended helmets will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets and visors are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet and visor may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented but have been omitted for purposes of brevity.

The invention claimed is:

1. A helmet comprising:

a helmet body comprising an outer liner and an inner liner each formed of energy-management material and configured to slidably move in relation to each other, the inner liner separate from the outer liner and comprising a first liner segment and a second liner segment separate from the first liner segment, the first liner segment and the second liner segment being formed of separate expanded polystyrene (EPS) portions, outer surfaces of the first liner segment and the second liner segment defining an ovoid outer surface of the inner liner, and a gap separating the first liner segment and the second liner segments, the first liner segment comprising a plurality of liner ribs extending from a front of the first liner segment, each of the plurality of liner ribs separated from another of the plurality of liner ribs by an adjacent gap;

at least one flexible connector positioned on the ovoid outer surface and directly connecting at least one of the plurality of liner ribs of the first liner segment to the second liner segment across the gap, the at least one flexible connector in-molded with the first liner segment and the second liner segment, wherein the first liner segment and the second liner segment are configured to move relative to each other when the inner liner slidably moves in relation to the outer liner by flexing the at least one flexible connector;

at least two elastomeric anchors coupled to the outer liner and to the at least one flexible connector; and a fit system coupled to the helmet body, the fit system comprising at least an occipital support coupled to the at least one flexible connector to couple the fit system to the inner liner.

2. The helmet of claim 1, wherein at least one of the at least two elastomeric anchors is disposed proximate the front of the first liner segment.

3. The helmet of claim 1, wherein the at least one flexible connector is formed of nylon.

4. The helmet of claim 1, wherein the at least one flexible connector extends between the plurality of liner ribs.

5. The helmet of claim 1, wherein the inner liner further comprises a fit system hanger coupled to the at least one flexible connector.

6. The helmet of claim 1, wherein the at least one flexible connector comprises a hinge section disposed across the at least one of the plurality of liner ribs.

7. A helmet comprising:

a helmet body comprising an outer liner and an inner liner each formed of energy-management material and configured to slidably move in relation to each other, the inner liner separate from the outer liner and comprising a first liner segment and a second liner segment separate from the first liner segment, outer surfaces of the first liner segment and the second liner segment defining an outer surface of the inner liner, and a gap between the first liner segment and the second liner segment, the first liner segment comprising a plurality of liner ribs extending from a front of the first liner segment, each of the plurality of liner ribs separated from another of the plurality of liner ribs by an adjacent gap;

at least one flexible connector positioned on the outer surface of the inner liner and directly connecting at least one of the plurality of liner ribs of the first liner segment to the second liner segment across the gap wherein the first and second liner segments are configured to move relative to each other when the inner liner slidably moves in relation to the outer liner by flexing the at least one flexible connector;

at least two elastomeric anchors coupled to the outer liner and to the at least one flexible connector; and a fit system coupled to the inner liner.

8. The helmet of claim 7, wherein at least one of the at least two elastomeric anchors is disposed proximate the front of the first liner segment.

9. The helmet of claim 7, wherein the at least one flexible connector is formed of nylon.

10. The helmet of claim 7, wherein the at least one flexible connector extends between the plurality of liner ribs.

11. The helmet of claim 7, wherein the inner liner further comprises a fit system hanger coupled to the at least one flexible connector.

12. The helmet of claim 7, wherein the fit system is coupled to the second liner segment.

13. The helmet of claim 7, wherein the at least one flexible connector comprises a hinge section disposed across the at least one of the plurality of liner ribs.

14. A helmet comprising:

a helmet body comprising an outer liner and an inner liner each formed of energy-management material and configured to slidably move in relation to each other, the inner liner separate from the outer liner and comprising a first liner segment and a second liner segment separate from the first liner segment, outer surfaces of the first liner segment and the second liner segment defining an outer surface of the inner liner, and a gap between the first liner segment and the second liner segment;

at least one flexible connector positioned on the outer surface of the inner liner and directly connecting the first liner segment to the second liner segment across the gap at a center portion of the second liner segment and at left and right sides of the second liner segment, wherein the first and second liner segments are configured to move relative to each other when the inner liner slidably moves in relation to the outer liner by flexing the at least one flexible connector;

at least two elastomeric anchors coupled to the outer liner and to the at least one flexible connector; and a fit system coupled to the inner liner.

15. The helmet of claim 14, wherein at least one of the at least two elastomeric anchors is disposed proximate a front of the first liner segment.

16. The helmet of claim 14, wherein the at least one flexible connector is formed of nylon.

17. The helmet of claim 14, wherein the first liner segment comprises a plurality of liner ribs extending from a front of the first liner segment, the at least one flexible connector extending between the plurality of liner ribs.

18. The helmet of claim 14, wherein the inner liner further comprises a fit system hanger coupling to the at least one flexible connector.

19. The helmet of claim 14, wherein the fit system is coupled to the second liner segment.

20. The helmet of claim 14, wherein the at least one flexible connector comprises a hinge section disposed across the first liner segment.

* * * * *